US011542757B2

(12) United States Patent
McLeary

(10) Patent No.: US 11,542,757 B2
(45) Date of Patent: Jan. 3, 2023

(54) VARIABLE EXTENSION TUBE ASSEMBLY WITH ADJUSTABLE INTERLOCK DEVICE

(71) Applicant: Halliburton Energy Services, Inc., Houston, TX (US)

(72) Inventor: Gordon McLeary, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/174,559

(22) Filed: Feb. 12, 2021

(65) Prior Publication Data

US 2022/0259928 A1 Aug. 18, 2022

(51) Int. Cl.
*E21B 17/07* (2006.01)
*E21B 43/04* (2006.01)

(52) U.S. Cl.
CPC ..... *E21B 17/07* (2013.01); *E21B 43/04* (2013.01)

(58) Field of Classification Search
CPC ..... E21B 17/046; E21B 17/07; E21B 43/04
See application file for complete search history.

(56) References Cited

U.S. PATENT DOCUMENTS

| | | | |
|---|---|---|---|
| 4,723,796 | A | 2/1988 | Nattel |
| 4,830,408 | A | 5/1989 | Reimert |
| 5,040,831 | A | 8/1991 | Lewis |
| 2016/0305224 | A1 | 10/2016 | Least et al. |

FOREIGN PATENT DOCUMENTS

| | | |
|---|---|---|
| EP | 0204128 | 4/1991 |
| JP | 2006-138364 | 6/2006 |
| WO | 03014521 | 2/2003 |

OTHER PUBLICATIONS

International Search Report and Written Opinion for Application No. PCT/S2021/019771, dated Nov. 2, 2021.

*Primary Examiner* — Taras P Bemko
(74) *Attorney, Agent, or Firm* — Scott Richardson; C. Tumey Law Group PLLC

(57) ABSTRACT

Systems and methods of the present disclosure relate to securing downhole conduits. A system comprises a first conduit comprising teeth extending along a circumference of the first conduit; a second conduit comprising apertures, the first conduit movably disposed within the second conduit; and a retaining clip disposed within the apertures, portions of the retaining clip operable to engage or disengage the teeth while the retaining clip is disposed within the apertures.

20 Claims, 5 Drawing Sheets

VARIABLE EXTENSION TUBE ASSEMBLY WITH ADJUSTABLE INTERLOCK DEVICE

BACKGROUND

In the oilfield, a jumper tube connection may be utilized to fluidly couple conduits by bridging a gap between the conduits. Jumper tubes may be employed to connect various conduits such as wells to manifolds, subsea flowlines to manifolds, or production assemblies. Present techniques to bridge the gap and couple the conduits may be insufficient or impractical in some scenarios.

BRIEF DESCRIPTION OF THE DRAWINGS

These drawings illustrate certain aspects of some examples of the present disclosure and should not be used to limit or define the disclosure.

DETAILED DESCRIPTION

Figure 1:
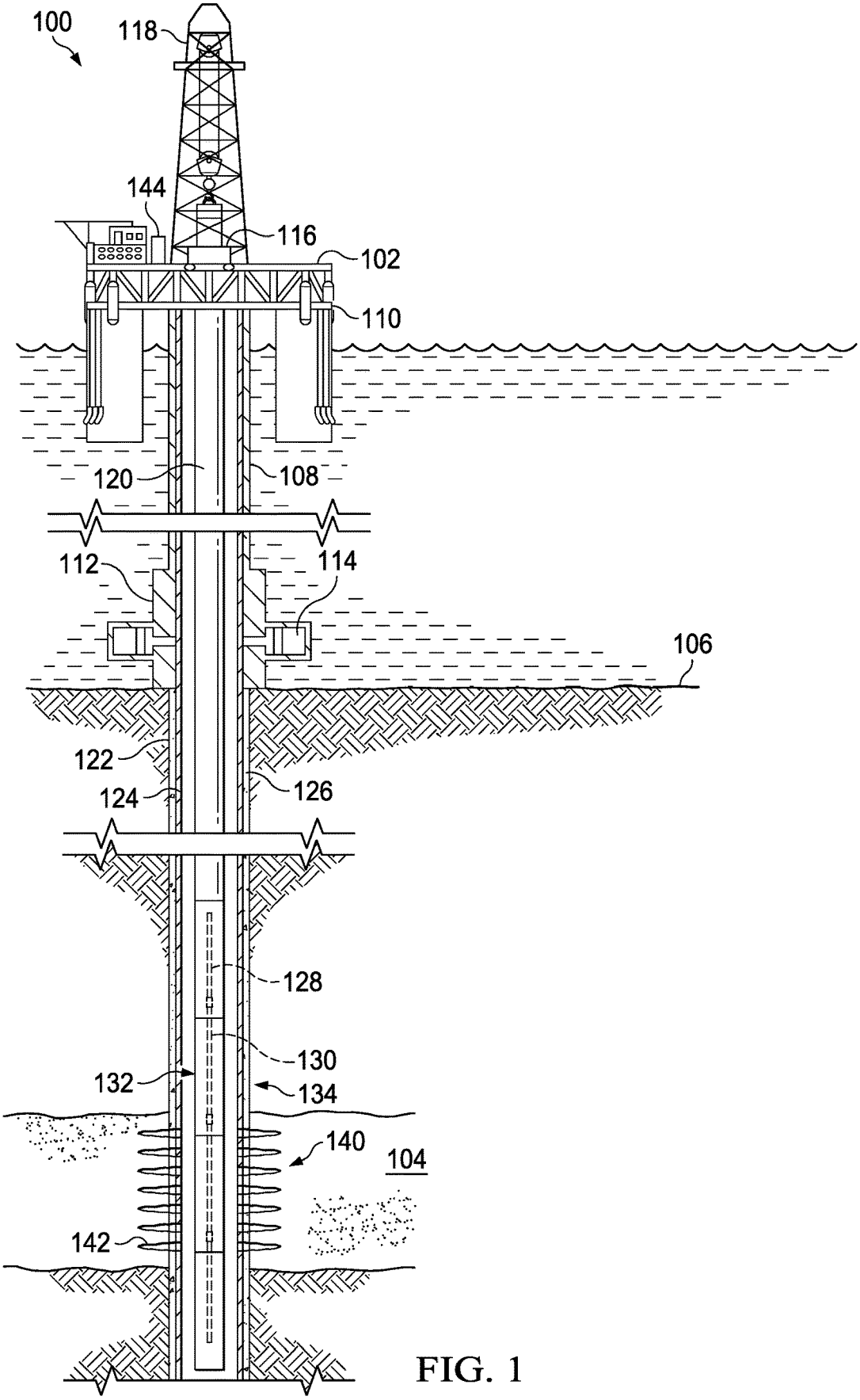
FIG. 1 illustrates an operating environment of a variable extension tube assembly with adjustable interlock device ("locking assembly"), in accordance with examples of the present disclosure.

The present disclosure generally relates to a variable length locking assembly including a first conduit that may be at least partially disposed within a second conduit. The locking assembly may be utilized with an extendable tube or a pipe assembly. The first conduit may be movably disposed within the second conduit and also may be coaxially aligned with the second conduit, in some examples.

A length of a section of the first conduit that may be disposed within the second conduit may be adjusted via moving the first conduit in axial directions. For example, in order to increase a length of a portion of the first conduit that is disposed within the second conduit, the first conduit may be moved into the second conduit (i.e., retraction).

To decrease the length of the first portion of the first conduit that is disposed within the second conduit, the first conduit may be moved out from within the second conduit (i.e., extension). The first conduit may include an outer diameter (OD) slightly less than an inside diameter (ID) of the second conduit which may form, for example, a telescopic configuration.

An outer surface of the first conduit may include an arrangement of projections that may extend along a circumference of the outer surface forming for example, bands.

Any of a variety of projections may be used, including, but not limited to ridges and/or teeth to secure a position of the first conduit within the second conduit. The second conduit may include apertures to receive a retaining clip (e.g., U-shaped clip) for engagement against the ridges (or teeth) of the first conduit. The apertures may be disposed on opposing sides of the second conduit. Portions of the retaining clip may be movably disposed within the apertures. Tips of the portions of the retaining clip may be operable to engage the ridges or teeth. The ridges or teeth may taper in an axial direction to allow unilateral movement of the first conduit.

For example, in order to prevent forward axial movement of the first conduit within the second conduit, the clip may be moved inward to engage the ridges of the first conduit and prevent forward axial movement of the first conduit within the second conduit. In some examples, the portions the retaining clip may be disposed or remain within the apertures while not engaged against the ridges or teeth, to prevent loss of the retaining clip at the rig site.

Although the retaining clip may be engaged against the teeth or the ridges of the first conduit, the profile of the teeth or ridges may allow for unilateral movement of the first conduit in a direction moving out of the second conduit. For example, the first conduit may be extended out from the second conduit such as for example, ratcheted out from the second conduit while the retaining clip is engaged against the ridge or teeth (or spaces therebetween) but prevent the first conduit from moving into the second conduit such as for example, during retracting.

In some examples, profiles, dimensions and/or material of the ridges or the teeth may be chosen based on axial load tolerances to provide controlled or sacrificial failure points (e.g., system pressure or load control). A ridge or tooth profile, a number of the ridges or the teeth, a retaining clip profile, a bearing face, and/or a parent material may be adjusted according to axial load ratings. In some examples, a tooth profile may prevent the complete separation of the first conduit from the second conduit.

The locking assembly as described herein may remove user input such as fastening additional components and may also remove any error due to failing to apply additional fasteners.

FIG. 1 illustrates a site 100 that may utilize a locking assembly for a series of conduits that may receive a fluid, in accordance with examples of the present disclosure. In some examples, the site 100 may include an offshore structure 102 (e.g., platform, rig, ship) may be positioned over a submerged subterranean formation 104 located below a sea floor 106. It should be understood that the disclosed techniques may also be suitable for use in onshore applications.

A conduit 108 may extend from deck 110 of the offshore structure 102 to a wellhead 112 including blowout preventers 114. The offshore structure 102 may include a hoisting apparatus 116 and a derrick 118 for raising and lowering a pipe string such as for example, a work string 120. It should be noted that examples of the present disclosure may also be applicable to sites on land.

A wellbore 122 may extend through the various earth strata including the subterranean formation 104. A casing 124 may be secured within the wellbore 122 by cement 126. The work string 120 may include various downhole components, such as conduits 128, conduits 130, and a downhole tool 132 such as, production equipment or completion equipment, for example, a packer, a screen, and/or a swell packer, among others. The conduits 128 and 130 may include upper and lower jumper tubes. Each conduit 128 and 130 may form an adjustable locking assembly 134. The conduits 128 may be disposed (e.g., welded) on a circumference of the tool 132. The conduits 130 may also be disposed along a circumference of the tool 132. The conduits 130 may be positioned downhole to the conduits 128. The tool 132 may extend through the arrangement of conduits 128 and 130.

In some examples, the conduits 128 may be referred to as upper jumper tubes, and the conduits 130 may be referred to as lower jumper tubes. The conduits 128 may have an OD that may be slightly less than the ID of the conduits 130 to allow for telescoping adjustment. In some examples, the adjustment may be unilateral (i.e., extension). The adjustable locking assembly 134 may prevent retraction of the conduits 128 into the conduits 130 upon axial loading of the work string 120.

To gravel pack a region 140 of the subterranean formation 104 that is adjacent to the wellbore 122, a slurry including a liquid carrier and a particulate material such as, for example, sand, gravel, or proppants, may be pumped down the work string 120 into the region 140 through a perforation 142 via pumping equipment 144 (e.g., container, pump). Although FIG. 1 depicts a vertical wellbore, examples of the present disclosure are equally well suited for use in wellbores having other directional configurations including horizontal wellbores, deviated wellbores, slanted wells, lateral wells, for example.

Figure 2:
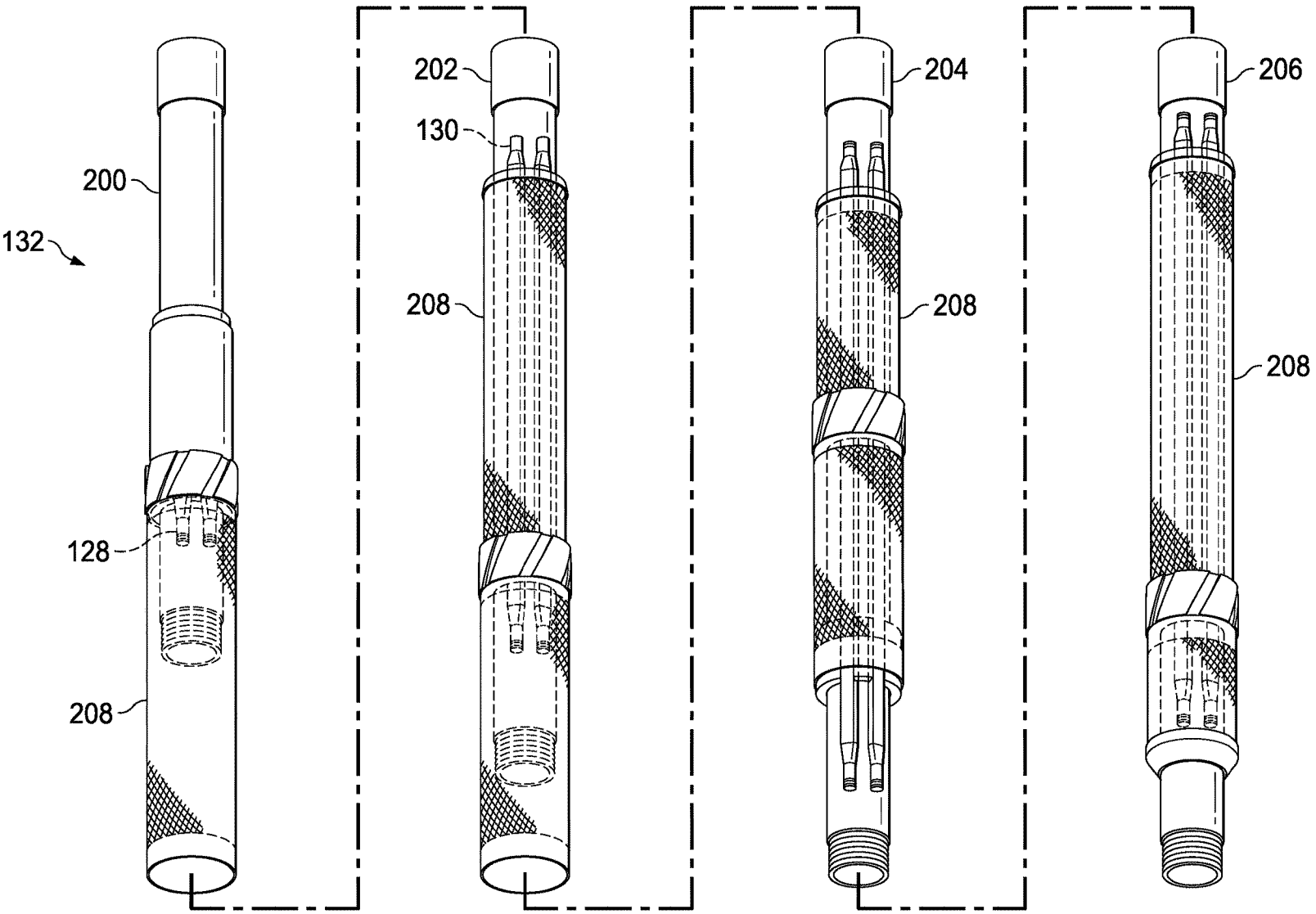
FIG. 2 illustrates an application of the locking assembly with completion equipment or production equipment, in accordance with examples of the present disclosure.

FIG. 2 illustrates the tool 132 including upper conduits 128 and lower conduits 130 which may form locking assemblies upon connecting multiple sections of the tool 132, in accordance with examples of the present disclosure. In some examples, the tool 132 may include multiple sections 200, 202, 204, and 206 which may be threaded together, for example, to form a shunt system. Each of the sections 200-206 may each include a tool or component of the tool such as, for example, a packer, or another conduit.

In some examples, the section 200 may include an entry joint such as atop joint on a completion string where entry for a gravel pack slurry into a shunt system may be located. The section 202 may include a slick joint such as a shunted blank used as a spacer. The section 204 may include a production joint with a shunt tube weldment installed for distributing the gravel pack slurry around the completion.

The section 206 may include a bottom joint. Each section 200-206 may include a screen in 208 disposed around the conduits 128 and 130, for gravel pack applications. The sections 200-206 may be coupled in an end-to-end configuration as illustrated. The conduits 128 and 130 may be coupled (e.g., welded) to the tool 132.

Each conduit 128 may be movably disposed within a conduit 130 (e.g., a second conduit) in a telescoping configuration, for example. The position of the conduits 128 within the conduits 130 may be variable. For example, the position of the conduits 128 within the conduits 130 may be adjusted to adjust overall length of the locking assembly.

Figure 3:
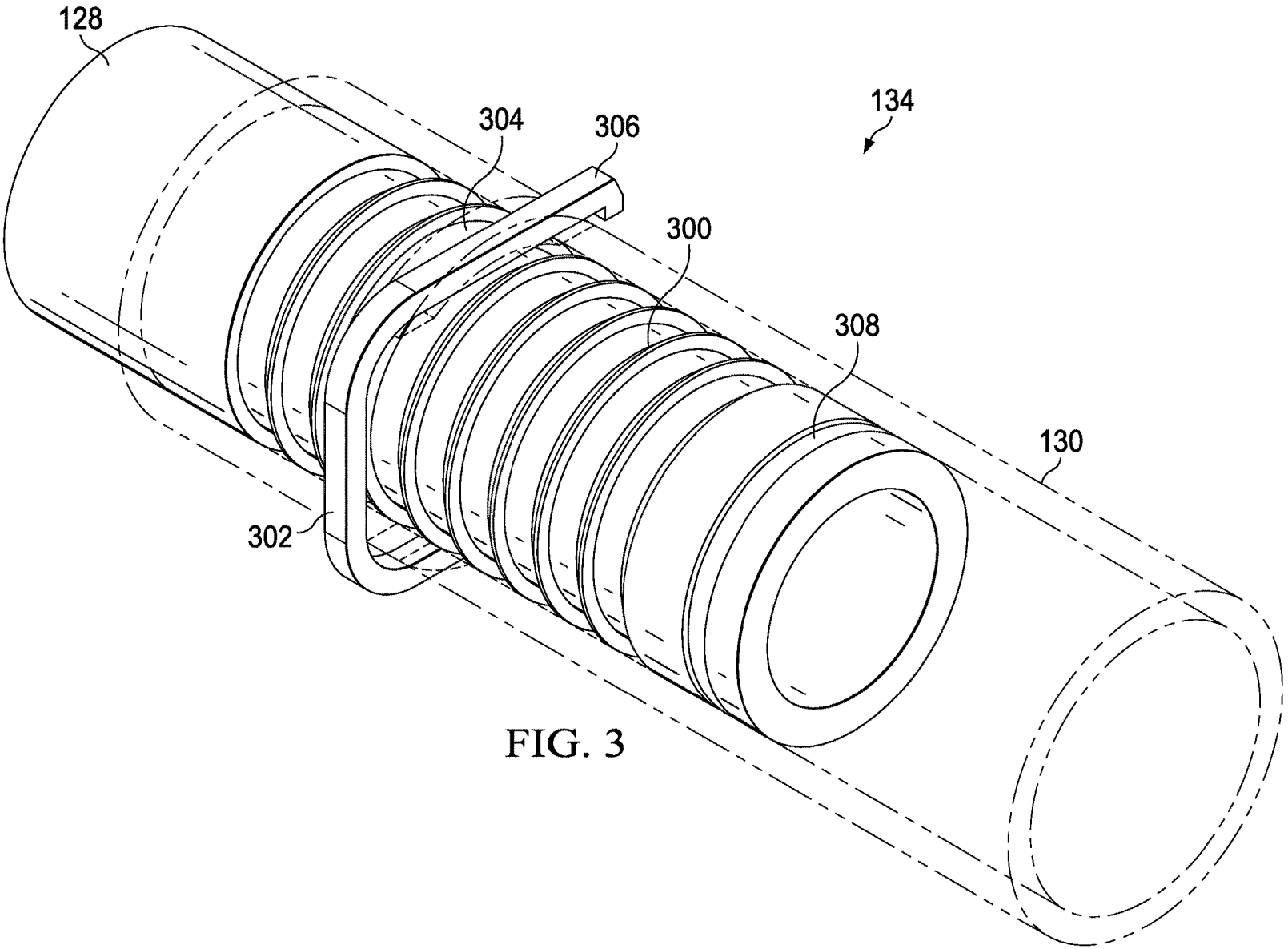
FIG. 3 illustrates a perspective view of the locking assembly, in accordance with examples of the present disclosure.

FIG. 3 illustrates a perspective view of a locking assembly 134, in accordance with examples of the present disclosure. The conduit 128 may be at least partially disposed within the conduit 130. The conduit 128 may be movable in axial directions (i.e., extension or retraction) within the conduit 130 in an unlocked configuration.

An outer surface of each conduit 128 may include an arrangement of ridges or teeth 300 that may extend along a circumference of the outer surface. The teeth 300 may be disposed between the upper end and a lower end of each conduit 128 such as a middle section, for example, to allow for adjustment.

Once at a desired position, the conduit 128 may be locked in place within the conduit 130 with a retaining clip 302 (e.g., U-shaped clip) for engagement against the teeth 300 of the conduit 128. For example, the conduit 130 may include apertures 304 to receive the retaining clip 302. The apertures 304 may be disposed on opposing sides of the conduit 130.

In order to prevent forward axial movement (i.e., retraction) of the conduit 128 within the conduit 130, the retaining clip 302 may be moved inward to engage the teeth 300 of the conduit 128 and prevent forward axial movement of the conduit 128 within the conduit 130. In some examples, the retaining clip 302 may be disposed within the apertures 304 while not engaged against the teeth 300, to prevent loss of the retaining clip 302.

Although the retaining clip 302 may be engaged against the teeth 300 of the conduit 128, the profile of the teeth 300 may allow for unilateral movement of the conduit 128 in a direction moving out of the conduit 130.

For example, the teeth 300 may taper inward in a direction that allows the conduit 128 to be extended out from the conduit 130 while the retaining clip 302 is engaged against the teeth 300 (or spaces therebetween) but prevent the conduit 128 from moving forward (e.g., retracting).

In a locked configuration, the conduit 128 may be operable to travel unilaterally such as extension. To lock the assembly 134, the retaining clip 302 may be moved inward to engage the teeth 300 of the conduit 128 and prevent retraction of the conduit 128 into the conduit 130.

As noted previously, the retaining clip 302 may be disposed within at least one aperture 304 while not engaged against the teeth 300, to prevent loss of the retaining clip 302. For example, a tip 306 of the retaining clip 302 may remain in the aperture 304 while disengaged from the teeth 300 when the retaining clip 302 is moved or pulled away from the conduit 130. In some examples, the retaining clip 302 may include a U-clip which may be sprung or snapped against the teeth 300 for engagement. A seal 308 (e.g., an o-ring) of the conduit 128 may be disposed within the conduit 130 to maintain a seal throughout the stroke of the conduit 128.

Figure 4A:
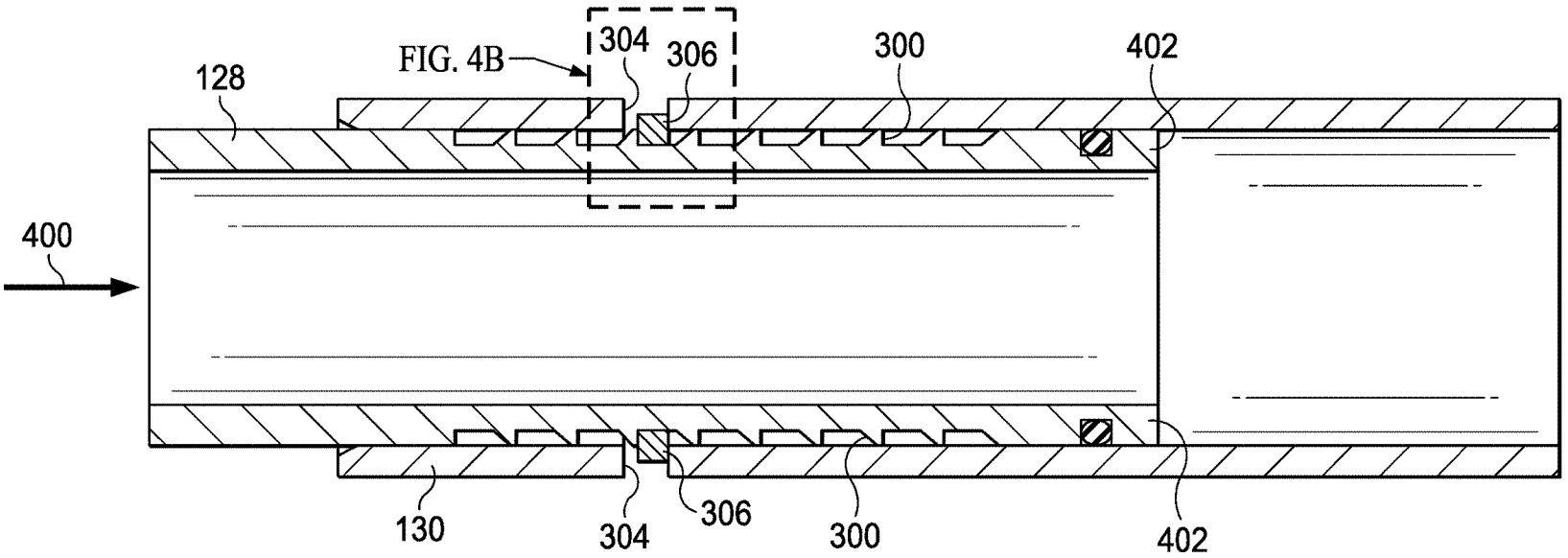
FIG. 4A illustrates a close-up cross-sectional view of the locking assembly, in accordance with examples of the present disclosure.

FIG. 4A illustrates a cross-sectional view of the locking assembly 134 in a locked configuration, in accordance with examples of the present disclosure. In the locked configuration, the conduit 128 may be operable to travel unilaterally. As illustrated, the tips 306 of the retaining clip 302 (e.g., shown on FIG. 3) may be disposed within the apertures 304 and may be moved inward to engage the teeth 300 of the conduit 128 and prevent retraction of the conduit 128 into the conduit 130.

In some examples, profiles, dimensions and/or material of the teeth 300 may be chosen based on axial load tolerances to provide controlled or sacrificial failure points (i.e., system pressure or load control). A tooth 300 profile, number of teeth, retaining clip profile, bearing face, and/or material may be adjusted according to axial load indicated by a directional arrow 400.

Additionally, in some examples, the conduit 128 may include a tooth 402 which may be operable to limit extension. For example, the tooth 402 may include a square profile to prevent the conduit 128 from being completely pulled out and separated from the conduit 130. In some examples, the tooth 402 may prevent a seal 308 (e.g., shown on FIG. 3) of the conduit 128 from being pulled out of the conduit 130. Also, a sufficient length of the first conduit 128 may need to be disposed within the second conduit 130 at full travel, for operability.

Figure 4C:
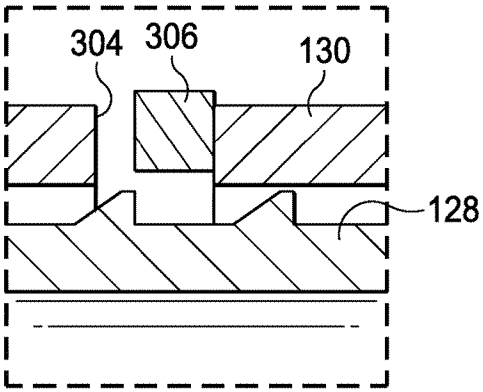
FIG. 4C illustrates the portion of the retaining clip disengaged from the teeth during non-use of the locking assembly, in accordance with examples of the present disclosure.
Figure 4B:
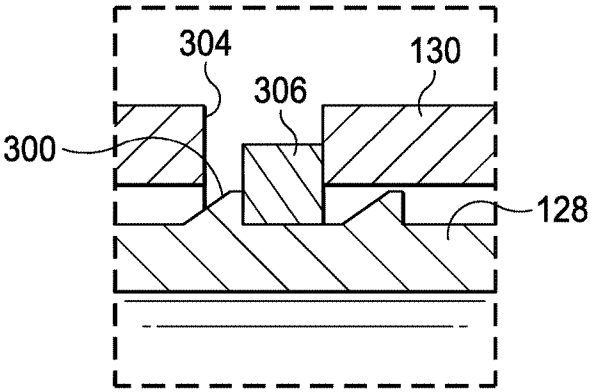
FIG. 4B illustrates a portion of a retaining clip engaging teeth of the locking assembly, in accordance with examples of the present disclosure.

FIG. 4B illustrates a close-up view of an aperture 304 in a locked configuration, in accordance with examples of the present disclosure. The tooth 300 may taper inward in a direction to allow the conduit 128 to be extended out of the conduit 130 or ratcheted out while a tip 306 of the retaining clip 302 (e.g., shown on FIG. 3) is engaged against the teeth 300 but prevent the conduit 128 from retracting.

FIG. 4C illustrates a close-up view of an aperture 304 in an unlocked configuration, in accordance with examples of the present disclosure. As illustrated, a tip 306 of the retaining clip 302 (e.g., shown on FIG. 3) may be disposed within the aperture 304 while not engaged against the teeth 300, to prevent loss of the retaining clip.

As noted previously, the retaining clip 206 may be disposed within at least one aperture 208 while not engaged against the teeth 204, to prevent loss of the retaining clip 206. In some examples, the retaining clip 206 may include U-clip which may be sprung or snapped into the aperture 208. The retaining clip 206 may disengage from the teeth 204 when the retaining clip 206 is moved or pulled away from the conduit 130, and the tip 300 may engage the teeth 204 when the retaining clip 206 is moved or pushed toward the conduit 130.

Figure 5:
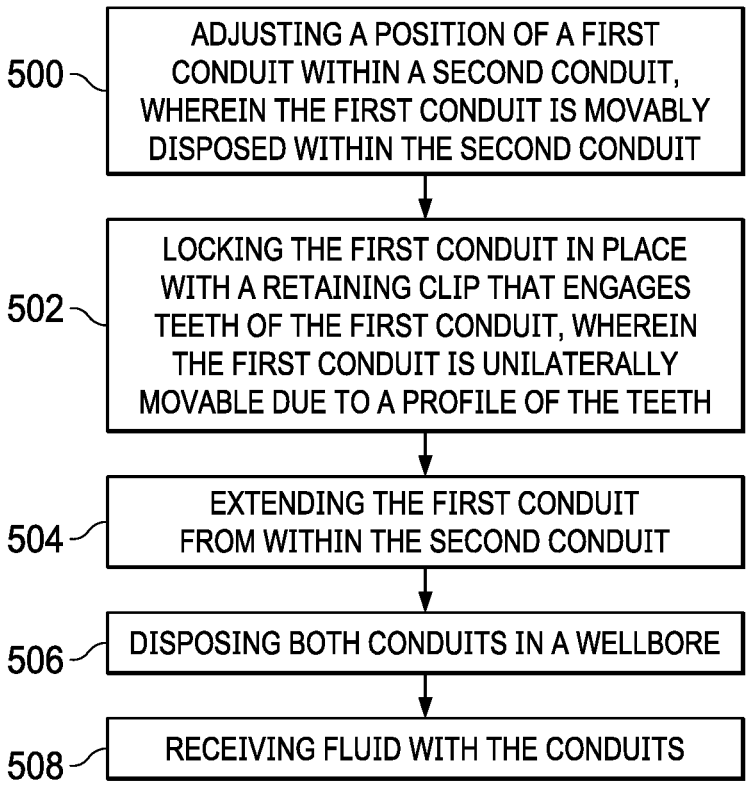
FIG. 5 illustrates a flow chart for locking the locking assembly, in accordance with examples of the present disclosure.

FIG. 5 illustrates a flow chart for locking a locking assembly, in accordance with examples of the present disclosure. At step 500, a locking assembly 134 may be provided at a site, as shown on FIG. 3, for example. A position of a first conduit (e.g., the conduit 128 shown on FIG. 3) within a second conduit (e.g., the conduit 130 shown on FIG. 3) may be adjusted on the surface before being disposed in a subterranean formation. In some examples, the first conduit may be moved axially within the second conduit until a desired position is reached.

At step 502, once at the desired position, the first conduit may be locked in place within the second conduit with a retaining clip such as a U-shaped clip (e.g., the retaining clip 206 shown on FIG. 3) for engagement against the teeth (e.g., the teeth 204) of the first conduit.

At step 504, the first conduit may be ratcheted out of the second conduit while in a locked configuration due to a profile of the teeth. The profiles may include tapering in an axial direction to allow the first conduit to move in the direction of the tapering but not in a direction opposite to the tapering, as shown on FIGS. 4A-4C, for example. This allows for adjustment after locking. Locking may refer to preventing retraction of the first conduit into the second conduit.

At step 506, after adjustment, both conduits may be disposed in a wellbore, as shown on FIG. 1, for example. Additionally, a gravel pack may be employed with the upper and lower conduits, as described herein.

At step 508, fluid may be moved through both conduits that are disposed in the wellbore. For example, the conduits may receive a slurry. The slurry including a liquid carrier and a particulate material such as, for example, sand, gravel, or proppants, may be pumped down a work string that may include the upper and lower conduits.

Accordingly, the systems and methods of the present disclosure may allow for extension of a telescopic conduit while preventing retraction of the telescopic conduit during adjustment with a locking assembly. The systems and methods may include any of the various features disclosed herein, including one or more of the following statements.

Statement 1. A system for securing downhole conduits, the system comprising: a first conduit comprising teeth extending along a circumference of the first conduit; a second conduit comprising apertures, the first conduit movably disposed within the second conduit; and a retaining clip disposed within the apertures, portions of the retaining clip operable to engage or disengage the teeth while the retaining clip is disposed within the apertures.

Statement 2. The system of the statement 1, wherein the teeth are positioned on an outer surface of the first conduit, wherein at least one tooth is operable to prevent complete separation of the first conduit from the second conduit or limit extension of the first conduit.

Statement 3. The system of the statement 1 or the statement 2, wherein the teeth are arranged in bands.

Statement 4. The system of any one of the preceding statements, wherein the teeth are tapered to allow extension of the first conduit from within the second conduit.

Statement 5. The system of any one of the preceding statements, wherein the teeth are tapered to prevent retraction of the first conduit into the second conduit.

Statement 6. The system of any one of the preceding statements, wherein the retaining clip includes a U-shaped clip disposed around a portion of the second conduit.

Statement 7. The system of any one of the preceding statements, wherein the first conduit is positioned up-hole to the second conduit.

Statement 8. The system of any one of the preceding statements, wherein the first conduit is coupled to an outer surface of completion equipment or production equipment.

Statement 9. A system for securing downhole conduits, the system comprising: a plurality of first conduits comprising teeth; a plurality of second conduits comprising apertures, the first conduits movably disposed within the second conduits; a plurality of retaining clips operable to pass through the apertures to contact the teeth of the first conduits; a downhole tool, wherein the first and second conduits are disposed around the downhole tool; and wherein the teeth are tapered to allow extension of the first conduits from within the second conduits and prevent retraction of the first conduits into the second conduits.

Statement 10. The system of the statement 9, wherein portions of the retaining clips are operable to engage the teeth while the retaining clips are disposed within the apertures.

Statement 11. The system of the statement 9 or the statement 10, wherein the portions of the retaining clips are operable to disengage the teeth while the retaining clips are disposed within the apertures.

Statement 12. The system of any one of the statements 9-11, wherein the downhole tool comprises completion equipment or production equipment.

Statement 13. The system of any one of the statements 9-12, wherein at least one tooth is a sacrificial point for load control.

Statement 14. The system of any one of the statements 9-13, wherein the teeth extend along a circumference of the first conduit.

Statement 15. The system of any one of the statements 9-14, wherein the teeth are arranged in bands.

Statement 16. A method for securing downhole conduits, the method comprising: adjusting a position of a first conduit within a second conduit, wherein the first conduit is movably disposed within the second conduit; and locking the first conduit in place with a retaining clip that engages teeth of the first conduit, wherein the first conduit is unilaterally movable due to a profile of the teeth.

Statement 17. The method of the statement 16, further comprising extending the first conduit from the second conduit while the retaining clip is engaged with the teeth.

Statement 18. The method of the statement 16 or 17, further comprising disposing a gravel pack adjacent to the first conduit.

Statement 19. The method of any one of the statements 16-18, further comprising disposing the gravel pack, the first conduit, and the second conduit in a wellbore.

Statement 20. The method of any one of the statements 16-19, further comprising receiving gravel with the gravel pack, the first conduit, and the second conduit.

Although the present disclosure and its advantages have been described in detail, it should be understood that various changes, substitutions and alterations may be made herein without departing from the spirit and scope of the disclosure as defined by the appended claims. The preceding description provides various examples of the systems and methods of use disclosed herein which may contain different method steps and alternative combinations of components. It should be understood that although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the elements that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A system for securing jumper tubes, the system comprising:

a first jumper tube comprising teeth extending along a circumference of the first jumper tube;

a second jumper tube comprising apertures, the first jumper tube movably disposed within the second jumper tube; and a retaining clip disposed within the apertures, portions of the retaining clip operable to engage or disengage the teeth while the retaining clip is disposed within the apertures, wherein the retaining clip is removable from the apertures, wherein straight portions of the retaining clip are operable to extend or retract through the second jumper tube to pass between the teeth of the first jumper tube, wherein profiles of the teeth are angled to allow for extension of the first jumper tube and not retraction of the first jumper tube while the retaining clip engages the teeth, wherein a tooth at a distal end of the first jumper tube includes a profile that is different than profiles of the other teeth.

2. The system of claim 1, wherein the teeth are positioned on an outer surface of the first jumper tube, wherein at least one tooth is operable to prevent complete separation of the first jumper tube from the second jumper tube or limit extension of the first jumper tube.

3. The system of claim 1, wherein the profile is operable to prevent loss of a seal between the jumper tubes.

4. The system of claim 3, wherein the seal is disposed adjacent to the tooth at the distal end of the first jumper tube.

5. The system of claim 1, wherein the first jumper tube is coupled to an outer surface of completion equipment or production equipment.

6. A system for securing jumper tubes, the system comprising:

a first jumper tube comprising teeth extending along a circumference of the first jumper tube;

a second jumper tube comprising apertures, the first jumper tube movably disposed within the second jumper tube; and a retaining clip disposed within the apertures, portions of the retaining clip operable to engage or disengage the teeth while the retaining clip is disposed within the apertures, wherein the retaining clip is removable from the apertures, wherein straight portions of the retaining clip are operable to extend or retract through the second jumper tube to pass between the teeth of the first jumper tube, wherein profiles of the teeth are angled to allow for extension of the first jumper tube and not retraction of the first jumper tube while the retaining clip engages the teeth, wherein a tooth at a distal end of the first jumper tube includes a square profile, wherein profiles of the other teeth include triangular profiles.

7. A system for securing jumper tubes, the system comprising:

a first jumper tube comprising teeth extending along a circumference of the first jumper tube;

a second jumper tube comprising apertures, the first jumper tube movably disposed within the second jumper tube; and a retaining clip disposed within the apertures, portions of the retaining clip operable to engage or disengage the teeth while the retaining clip is disposed within the apertures, wherein the retaining clip is removable from the apertures, wherein straight portions of the retaining clip are operable to extend or retract through the second jumper tube to pass between the teeth of the first jumper tube, wherein profiles of the teeth are angled to allow for extension of the first jumper tube and not retraction of the first jumper tube while the retaining clip engages the teeth, wherein an o-ring is disposed around a distal end of the first jumper tube.

8. The system of claim 7, wherein the o-ring is disposed between teeth that are shaped differently.

9. A system for securing jumper tubes, the system comprising:

a plurality of first jumper tubes comprising teeth;

a plurality of second jumper tubes comprising apertures, the first jumper tubes movably disposed within the second jumper tubes;

a plurality of retaining clips operable to pass through the apertures to contact the teeth of the first jumper tubes, wherein each retaining clip is removable from the apertures, wherein straight portions of the retaining clips are operable to extend or retract through the second jumper tubes to pass between the teeth of the first jumper tubes;

a downhole tool, wherein the first and second jumper tubes are disposed around the downhole tool;

wherein the teeth are tapered to allow extension of the first jumper tubes from within the second jumper tubes and prevent retraction of the first jumper tubes into the second jumper tubes;

wherein profiles of the teeth are operable to allow for unilateral movement of the first jumper tubes while the retaining clips engage the teeth; and wherein a tooth at a distal end of the first jumper tube includes a profile that is different than profiles of the other teeth.

10. The system of claim 9, wherein portions of the retaining clips are operable to engage the teeth while the retaining clips are disposed within the apertures.

11. The system of claim 10, wherein the portions of the retaining clips are operable to disengage the teeth while the retaining clips are disposed within the apertures.

12. The system of claim 9, wherein the downhole tool comprises completion equipment or production equipment.

13. The system of claim 9, wherein at least one tooth is a sacrificial point for load control.

14. The system of claim 9, wherein the teeth extend along a circumference of the first jumper tube.

15. The system of claim 9, wherein the teeth are arranged in bands.

16. A method for securing jumper tubes, the method comprising:

adjusting a position of a first jumper tube within a second jumper tube, wherein the first jumper tube is movably disposed within the second jumper tube;

locking the first jumper tube in place with a retaining clip that engages teeth of the first jumper tube, wherein the retaining clip is removable from apertures of the second jumper tube, wherein straight portions of the retaining clip are operable to extend or retract through the second jumper tube to pass between the teeth of the first jumper tube, wherein profiles of the teeth are operable to allow for unilateral movement of the first jumper tube while the retaining clip engages the teeth; and adjusting the first jumper tube within the second jumper tube via ratcheting.

17. The method of claim 16, further comprising extending the first jumper tube from the second jumper tube while the retaining clip is engaged with the teeth.

18. The method of claim 16, further comprising disposing the first jumper tube in a wellbore.

19. The method of claim 18, further comprising disposing the second jumper tube in the wellbore.

20. The method of claim 19, further comprising receiving gravel with the first jumper tube and the second jumper tube.

* * * * *